US007716764B2

(12) United States Patent
Joe et al.

(10) Patent No.: US 7,716,764 B2
(45) Date of Patent: May 18, 2010

(54) INFANT POSITIONER

(76) Inventors: Trinh Doan Joe, 14 Dianthus Dr., Asheville, NC (US) 28803; Cynthia Ann Miller, 144 Bright Gem Dr., St. Charles, MO (US) 63304

( * ) Notice: Subject to any disclaimer, the term of this patent is extended or adjusted under 35 U.S.C. 154(b) by 309 days.

(21) Appl. No.: 11/584,091

(22) Filed: Oct. 19, 2006

(65) Prior Publication Data

US 2008/0092300 A1 Apr. 24, 2008

(51) Int. Cl.
*A47D 13/08* (2006.01)

(52) U.S. Cl. ..... 5/655; 5/603; 5/632; 5/731

(58) Field of Classification Search ..... 5/603, 5/655, 731, 632

See application file for complete search history.

(56) References Cited

U.S. PATENT DOCUMENTS 2,751,268 A * 6/1956 Creelman ..... 5/603
4,441,221 A * 4/1984 Enste et al. ..... 5/657
4,516,282 A 5/1985 Topalian et al.
4,566,449 A 1/1986 Smith
4,631,766 A 12/1986 Semmler et al.
5,127,422 A * 7/1992 Colon ..... 5/655
5,261,133 A 11/1993 Wilkerson
5,329,934 A * 7/1994 Bowman ..... 5/603
5,524,640 A 6/1996 Lisak et al.
2002/0133881 A1 * 9/2002 Vrbas et al. ..... 5/655

* cited by examiner

*Primary Examiner*—Thomas B Will
*Assistant Examiner*—Gilbert Y Lee
(74) *Attorney, Agent, or Firm*—Carter, Schnedler & Warnock, P.A.

(57) ABSTRACT

A device for supporting and positioning an infant, particularly a premature infant, in a tucked prone position. An elongated base layer extends lengthwise from a head end to a feet end, and includes, in order, a head support portion having a width at least sufficient to fully support the head of the infant, a torso support portion having a width sized to correspond to the width of the torso of the infant, and a pelvis support portion terminating in an upwardly extending rear support for the buttocks of the infant. Arm recesses are formed in the torso support portion, and pair of upwardly and rearwardly extending lateral supports extend lengthwise from the arm recesses to the feet end of the device. Leg recesses are defined between, on the one hand, the upwardly extending lateral supports, and, on the other hand, the pelvis support portion and the upwardly extending rear support.

14 Claims, 5 Drawing Sheets

INFANT POSITIONER

BACKGROUND OF THE INVENTION

The invention relates generally to devices for supporting and positioning infants and, more particularly, to infants such as prematurely-born babies, in an appropriate position.

It is well known that certain infants have developmental requirements which are improved through proper support and positioning. A number of infant supports and positioners are known.

SUMMARY OF THE INVENTION

In one aspect, an infant positioner for supporting and positioning an infant in a tucked prone position is provided. The infant positioner is made of a resilient foam material having a density for supporting the infant. The infant positioner includes an elongated base layer extending lengthwise from a head end to a feet end. The elongated base layer in turn includes, in order, a head support portion having a width at least sufficient to fully support the head of the infant, a torso support portion having a width sized to correspond to the width of the torso of the infant, and a pelvis support portion. Arm recesses are formed in the torso support portion extending through the entire thickness of said torso support portion. The arm recesses are configured and located in a position generally corresponding to the shoulders of the infant such that the arms of the infant are allowed to be rounded and tucked into a position of flexion. The pelvis support portion ranges in width from the width of the torso support portion to a narrower width corresponding to the distance between the legs of the infant. The pelvis support portion terminates in an upwardly extending rear support for the buttocks of the infant. The upwardly extending rear support has a width corresponding to the distance between the legs of the infant and is configured so as to allow the infant to maintain the tucked prone position without sliding towards the feet end of the infant positioner. A pair of upwardly and rearwardly extending lateral supports are connected to the torso support portion. The upwardly extending lateral supports are spaced a distance apart corresponding to the width of the torso of the infant, and extend lengthwise from the arm recesses to the feet end of the infant positioner. A pair of leg recesses are provided. Each of the leg recesses is defined between one of the upwardly extending lateral supports and the pelvis support portion and the upwardly extending rear support which terminates the pelvis support portion.

DETAILED DESCRIPTION

Figure 1:
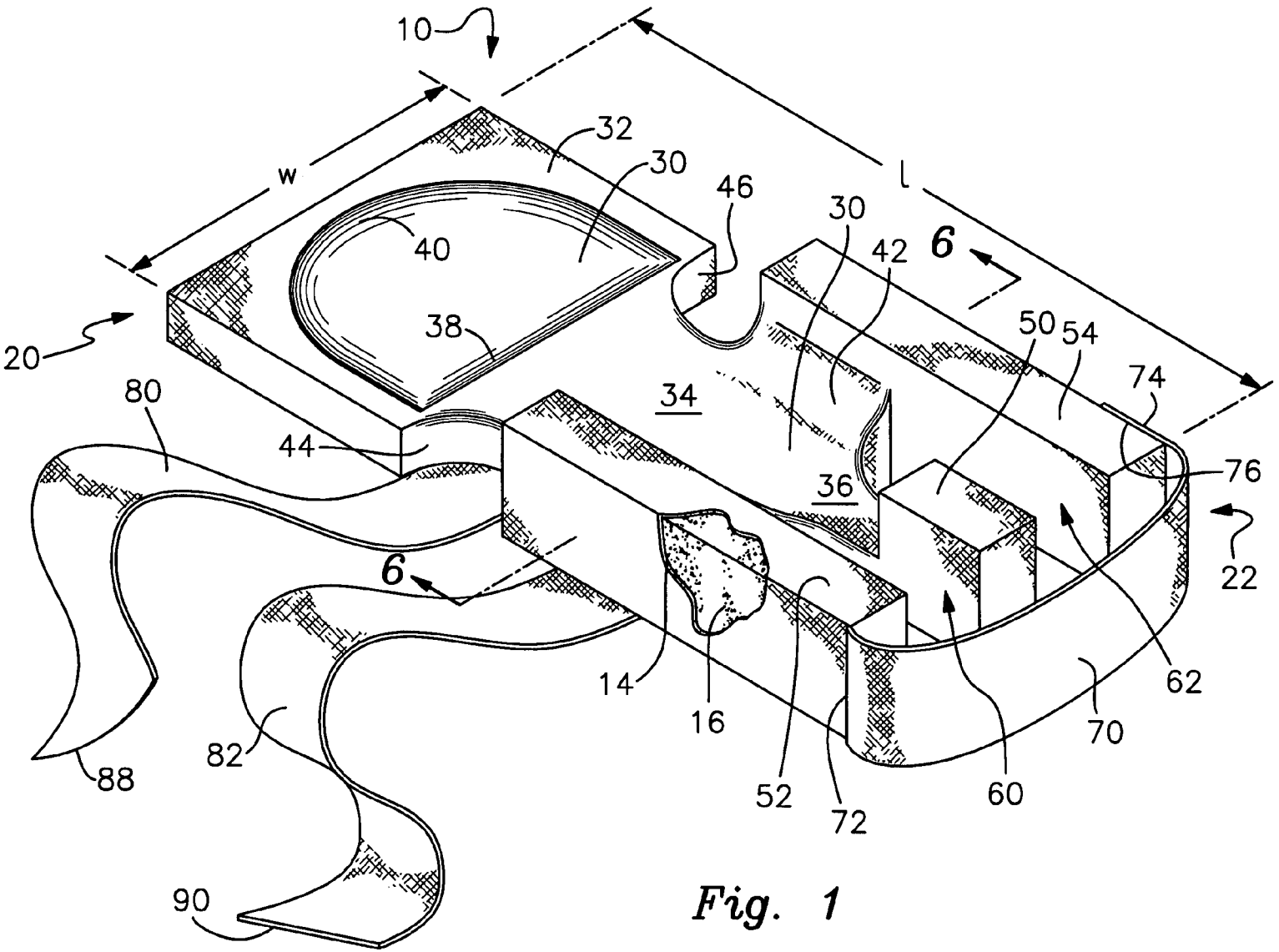
FIG. 1 is a three-dimensional view of an infant positioner embodying the invention, with a portion cut away to show a fabric cover over resilient foam material.
Figure 7:
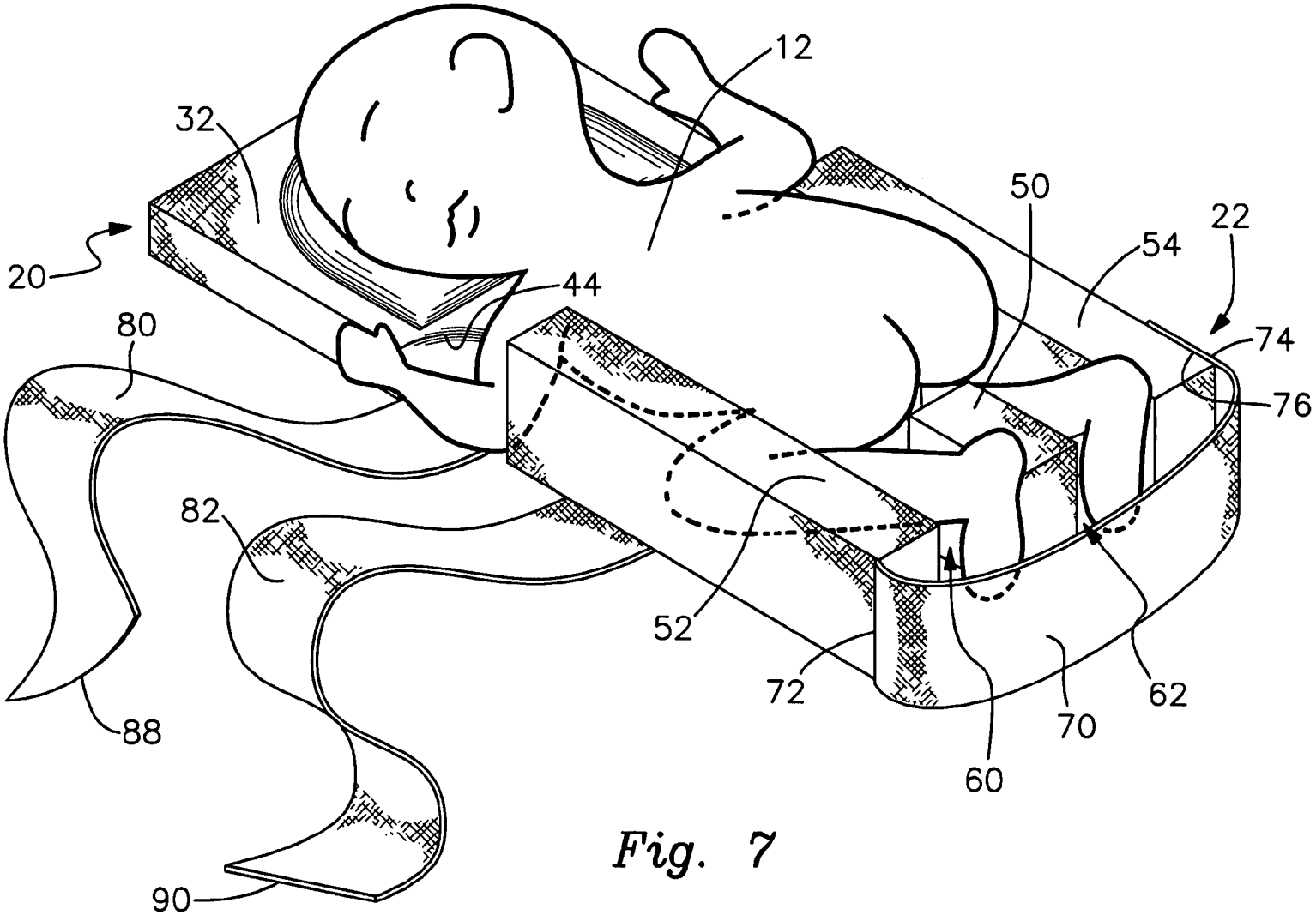
FIG. 7 is a three-dimensional view of the infant positioner of FIG. 1 in the same orientation as FIG. 1, and with an infant in a tucked prone position, prior to securing the infant with upper back and hip area containment straps.
Figure 8:
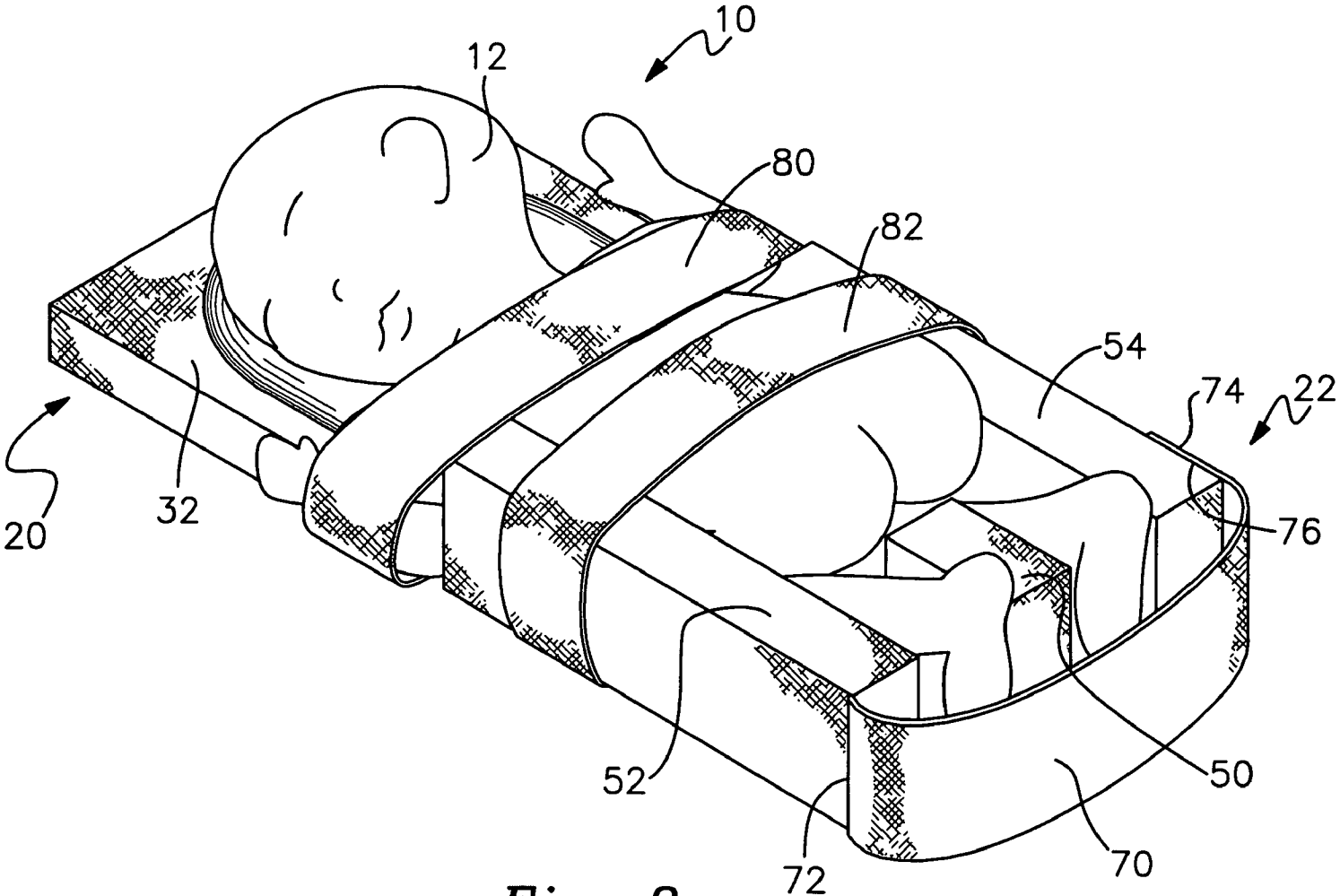
FIG. 8 is a three-dimensional view comparable to that of FIG. 7, but with the upper back and hip area containment straps in their in-use position.

With reference to the three-dimensional views of FIGS. 1, 7, and 8, shown is an infant positioner 10 embodying the invention for supporting and positioning an infant 12 (FIGS. 7 and 8) in a tucked prone position, and which is also referred to herein as an infant positioner 10. The infant positioner 10 is intended to be placed within a suitable bed (not shown) for the infant 12, and typically is employed in combination with bedding (not shown) . More particularly, the infant positioner 10 can be used within an isolette, radiant warmer, or crib in a neonatal intensive care unit (NICU) or nursery in a hospital. To provide additional containment, the infant positioner 10 can be used in combination with other positioning supports.

Outside of the in-utero environment, premature infants may be unable to maintain an optimal tucked prone position. While in the in-utero sac with the enclosed boundaries and the buoyancy of the amniotic fluid, the infant can maintain a comfortable tucked position for a long period of time. However, while positioned in prone outside of the in-utero environment the infant, especially a premature infant, may not be able to maintain the optimal tucked position for a long period of time with the forces of gravity on his or her under-developed muscles. While in the infant positioner 10, the infant 12 is able to maintain this position due to the supportive elements described hereinbelow in detail, with less stress on the joints and decreased weight bearing impact on the extremities of the infant 12. At the same time, there is enough flexibility so that the infant 12 can generally move as desired.

The infant positioner 10 thus promotes the ability of the infant 12 to assume a position of flexion while in prone, to better replicate the position the infant 12 would have been in-utero, and accordingly to at least somewhat simulate the experience of the infant 12 in-utero. The infant positioner 10 accordingly can be employed for positioning and supporting prematurely-born babies in a developmentally appropriate tucked prone position, as well as for post-surgical babies requiring prolonged prone positioning. One example is an infant with Spina Bifida who needs to be in the prone position for an extended period of time after myelomeningocele repair. There are other surgical procedures with similar requirements.

Figure 4:
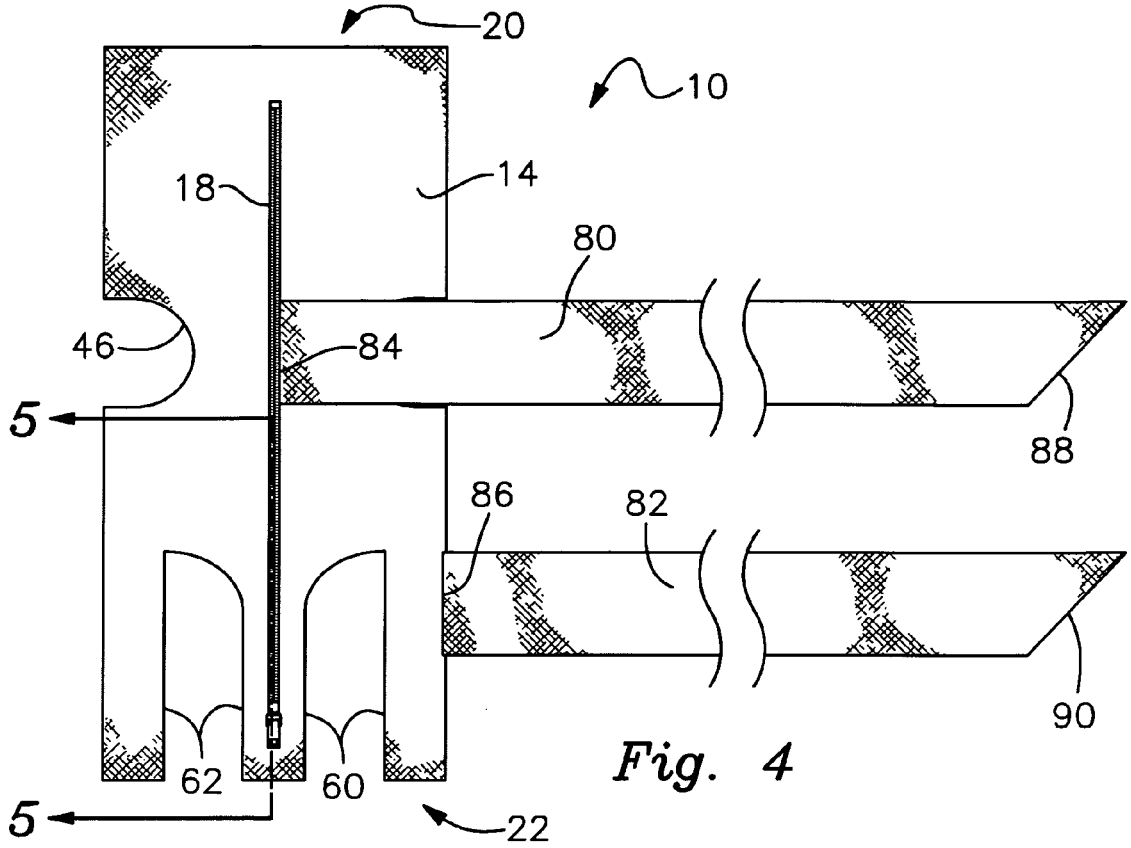
FIG. 4 is a bottom view of the infant positioner.
Figure 5:
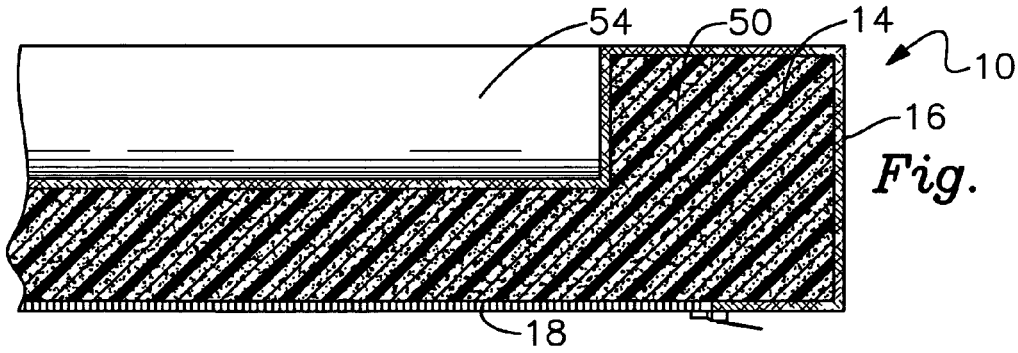
FIG. 5 is a cross section taken on line 5-5 of FIG. 4.

The infant positioner 10 is generally made of a resilient foam material having a density for supporting the infant 12, with a thickness that can vary depending on the size of the infant 12. In the illustrated embodiment, a form-fitting, removable washable fabric cover 14 is provided over a resilient foam material core 16, visible in the cut away portion of FIG. 1. The cover 14 can be made of a wipeable bi-directional stretch fabric. With reference to the underside view of FIG. 4 and the cross-section of FIG. 5, a zippered aperture 18 is provided so that the cover 14 can be removed and washed. Accordingly, a sanitary environment for the infant 12 is facilitated.

Figure 2:
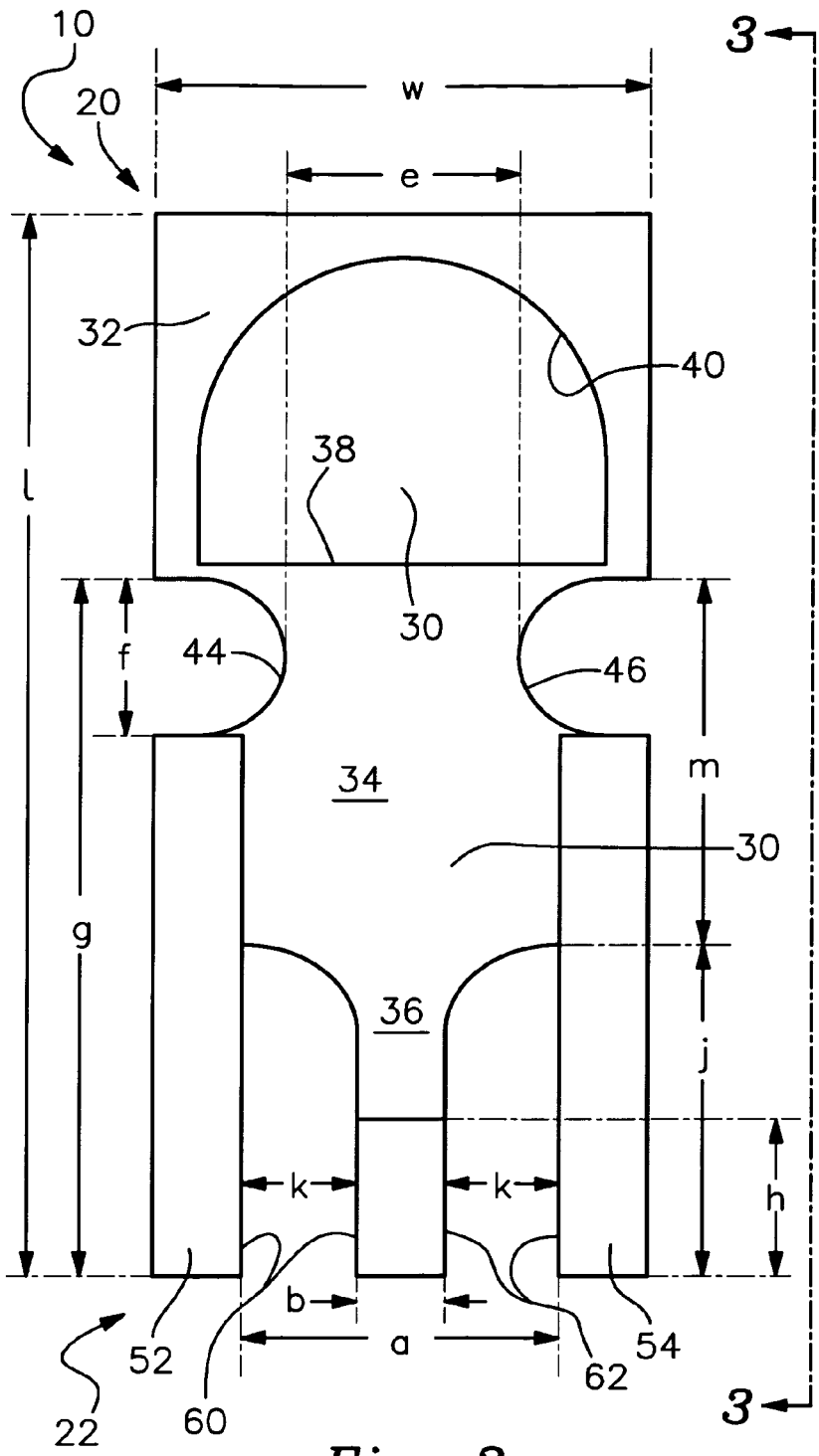
FIG. 2 is a somewhat diagrammatic plan view of the main body of the infant positioner of FIG. 1, with various dimensions designated.
Figure 3:
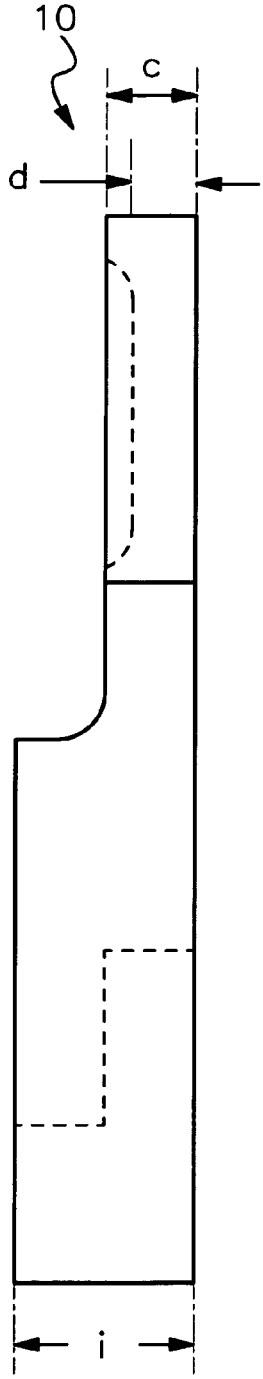
FIG. 3 is a somewhat diagrammatic side elevational view taken on line 3-3 of FIG. 2, with further dimensions designated.

Referring to the dimensioned diagrammatic views of FIGS. 2 and 3, as well as to the three-dimensional views of FIGS. 1, 7 and 8, the infant positioner 10 has a head end 20 and a foot end 22 defining a length l between the two ends 20 and 22, as well as a width w. The infant positioner 10 includes an elongated base layer 30 extending lengthwise from the head end 20 to the feet end 22. The elongated base layer 30 includes, in order, a head support portion 32 having a width at least sufficient to fully support the head of the infant 12, a torso support portion 34 having a width a sized to correspond to the width of the torso of the infant 12, and a pelvis support portion 36. In the illustrated embodiment, the width of the head support portion 32 corresponds to the width w of the infant positioner 10. The pelvis support portion 36 ranges in width from the width a of the torso support portion 34 to a narrower width b corresponding to the distance between the legs of the infant 12.

Along a transition zone 38, the base layer 30 decreases in thickness from the torso support portion 34 (thickness c) to a cavity 40 in the head support portion 32 (thickness d) of the base layer 30. The transition zone 38 and cavity 40 allow the upper back of the infant 12 to assume a more rounded position. The cavity 40 has a "U" shape in plan view, and a shallow curvature in cross-section. One function of the cavity 40 is to assist in maintaining the head of the infant 12 in a centered position widthwise and lengthwise. In addition, the decrease in thickness d of the cavity 40 in the head support portion 32 compared to the thickness c of torso support portion 34 effectively discourages the infant 12 from extending his or her head back and possibly extubating in the event the infant 12 has an endotracheal tube, or disconnecting from a nasal continuous positive airway pressure prong. The cavity 40 also limits the infant 12 from scooting too far up in the infant positioner 10.

Figure 6:
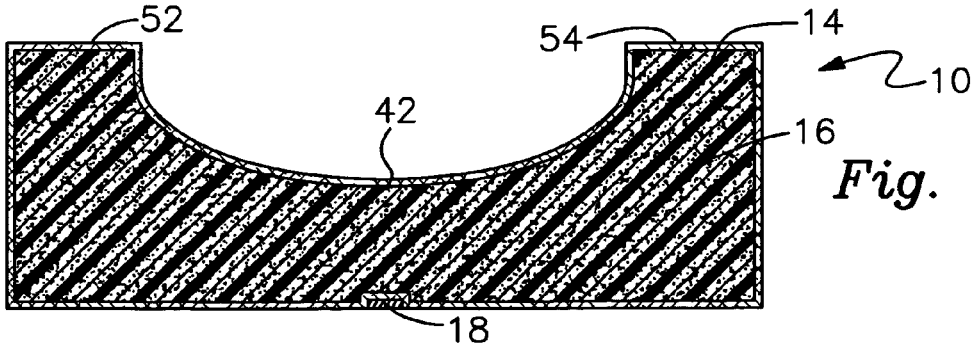
FIG. 6 is a cross section taken on line 6-6 of FIG. 1.

Referring also to the cross-sectional view of FIG. 6, a shallow longitudinal trough 42 is formed in the torso and pelvis support portions 34 and 36. This shallow longitudinal trough 42 maximizes support area for the torso of the infant 12, and promotes ease of breathing.

Arm recesses 44 and 46 are provided in the torso support portion 34, extending all the way through the elongated base layer 30, and located in a position generally corresponding to the shoulders of the infant 12. The edges of the arm recesses 44 and 46 immediately adjacent the transition zone 38 also correspond to the position of the neck of the infant 12. The arm recesses 44 and 46 allow the arms of the infant to be rounded and tucked into a position of flexion. Further, this promotes the scapula to rest in a relaxed protracted position. This position encourages the infant to bring his or her hands toward the mouth to assist with self soothing. The arm recesses 44 and 46 generally have a "U" configuration and are large enough to accommodate the arms of the infant. The widthwise distance between the arm recesses 44 and 46 is referenced as e, and the lengthwise height of the arm recesses 44 and 46 is referenced as f. The longitudinal distance from the neck of the infant 12 to the feet end 22 of the infant positioner is referenced as g. In order to provide a smoother surface for the shoulders of the infant to rest upon, there is a gradual slope from the top of the arm recesses 44 and 46 towards the bottom.

To allow sufficient depth for the infant 12 to tuck his or her arms into the arm recesses 44 and 46, the thickness c of the torso support portion 34 of the base layer 30 in the vicinity of the arm recesses 44 and 46 is about three-fourths the length of the humerus of the infant.

The pelvis support portion 36 transitions in width and terminates in an upwardly-extending rear support 50 for the buttocks of the infant 12, which support 50 has a width b corresponding to the distance between the legs of the infant 12. Thus, and as noted above, the pelvis support portion 36 ranges in width from the width a of the torso support portion 34 to the narrower width b of the upwardly-extending rear support corresponding to the distance between the legs of the infant 12. In the illustrated infant positioner 10, the upwardly-extending rear support 50 extends to the feet end 22 of the infant positioner 10, and has a length h. The upwardly-extending rear support 50 is laterally centered, wide enough to support the buttocks of the infant 12, and has a height i which is approximately the height of the buttocks 12 of the infant while the infant is in the tucked prone position. The upwardly-extending rear support 50 is an important element of the infant positioner 10, and allows the infant 12 to maintain the tucked prone position without sliding towards the feet end 22 of the infant positioner 10. Sliding down can otherwise occur if the bedding is placed in a tilted position, or the infant 12 squirms down.

In order to provide boundaries and containment to the torso, pelvis and legs of the infant 12, a pair of upwardly and rearwardly-extending lateral supports 52 and 54 are connected to the torso support portion 34, and extend lengthwise from the arm recesses 44 and 46 to the feet end 22 of the infant positioner 10. The lateral supports 52 and 54 are spaced a distance apart corresponding to the width a of the torso of the infant 12. Viewed from the side, the lateral supports 52 and 54 are preferably approximately the height of the torso of the infant 12, when the infant 12 is positioned within the infant positioner 10. The height i of the upwardly-extending lateral supports 52 and 54 and of the upwardly-extending rear support 50 is determined by the size of the infant 12.

A pair of leg recesses 60 and 62 is provided to receive the legs of the infant 12, and to allow the infant 12 to tuck and extend his or her lower extremities as desired. More particularly, each of the leg recesses 60 and 62 is defined between one of, the upwardly-extending lateral supports 52 and 54, and the pelvis support portion 36 and the upwardly-extending rear support 50 which terminates the pelvis support portion. The leg recesses 60 and 62 begin approximately where the torso support portion 34 and the pelvis support portion 36 interface with each other, and extend to the feet end 22 of the positioner 10, and all the way through the thickness of the base layer 30. The leg recesses 60 and 62 are shaped and are large enough so as to accommodate the lower extremity of the infant 12, but still provide containment and boundaries for the infant 12. In FIG. 2, the length of the leg recesses 60 and 62 is designated j, and the width is designated k. The longitudinal distance from the position of the neck of the infant 12 to the beginning of the leg recesses 60 and 62 is designated m.

As noted above, embodiments of the invention provide flexible containment for the infant 12, to at least simulate the experience of the infant 12 in-utero, as an infant frequently braces his or her feet against the uterine walls. As part of that containment, a foot brace 70 is provided, in the form of webbing 70 extending across the feet end 22 of the positioner 10, at least between the upwardly-extending lateral supports 52 and 54. During use, the foot brace 70 is in contact with the soles of the infant's feet in the same manner as the feet had contact with the uterine walls while the infant wa in-utero. In the illustrated embodiment, the webbing of the foot brace 70 is sewn at one end 72 to the fabric cover 14 at the end of the upwardly-extending lateral support 52. The webbing 70 has a free end 74 which is attached to the other upwardly-extending lateral support 54 in a manner which supports repeated attachment and detachment, such as by employing a hook and loop fastener 76.

As further containment for the infant 12, a pair of containment straps 80 and 82 are provided, the containment strap 80 generally extending over the upper back of the infant 12 when in use, and the containment strap 82 generally extending over the hip area of the infant when in use. As can be seen in the underside view of FIG. 4, the containment straps 80 and 82 have respective attached ends 84 and 86 which are sewn to the fabric cover 14, and free distal ends 88 and 90. In use, as illustrated in FIG. 8, the free ends 88 and 90 of the containment straps 80 and 82 are wrapped around and underneath the infant positioner 10, and are held in place by frictional forces due to the weight of the infant 12 and positioner 10. Optionally, hook and loop fasteners (not shown) may be employed to secure the distal ends 88 and 90 of the containment straps 80 and 82 to the underside of the positioner 10. In use (FIG. 8), the containment straps 80 and 82 provide containment and boundaries for the infant 12, again simulating the contained in-utero environment.

An important aspect of the invention is appropriate sizing and dimensioning of the positioner 10. Correct sizing and dimensioning is important for comfort of the infant 12. Although an infant positioner 10 embodying the invention can be custom made based on the measurements of an individual infant, an aspect of the invention is providing infant positioners 10 in a plurality of standardized sizes. In the embodiment described herein, three sizes are provided: "Size A" generally for a 25-29 week premature infant, "Size B" generally for a 29-32 week premature infant, and "Size C" generally for a 32-36 week premature infant. With particular reference to FIGS. 2 and 3, the following table indicates certain dimensions of the infant positioner 10 for these three sizes. It should be noted that, due to variations in size versus age of individuals, these measurements and sizes are not absolute for every infant.

TABLE

| | Reference | Size A | Size B | Size C |
|---|---|---|---|---|
| Length of infant positioner 12 | l | 380 mm | 400 mm | 420 mm |
| Width of infant positioner 12 | w | 160 mm | 180 mm | 200 mm |
| Width between supports 52 and 54 for torso | a | 91 mm | 104 mm | 110 mm |
| Width of upwardly-extending rear support 50, between legs of infant | b | 35 mm | 40 mm | 40 mm |
| Thickness of foam in the vicinity of arm recesses 44 and 46 | c | 25 mm | 30 mm | 35 mm |
| Thickness of foam within cavity 40 in head support portion 32 | d | 20 mm | 25 mm | 30 mm |
| Distance between arm recesses 44 and 46 | e | 70 mm | 75 mm | 80 mm |
| Longitudinal extent of arm recesses 44 and 46 | f | 60 mm | 65 mm | 70 mm |
| Longitudinal distance - neck to feet end 22 | g | 210 mm | 230 mm | 240 mm |
| Length of upwardly-extending rear support 50 | h | 50 mm | 55 mm | 60 mm |
| Height of upwardly-extending supports 50, 52, 54 | i | 75 mm | 80 mm | 90 mm |
| Length of leg recesses 60 and 62 | j | 110 mm | 115 mm | 115 mm |
| Width of leg recesses 60 and 62 | k | 28 mm | 32 mm | 35 mm |
| Longitudinal distance - neck to leg recesses 60 and 62 | m | 110 mm | 120 mm | 125 mm |

Of the foregoing dimensions, the most important ones from the point of view of providing a plurality of standard sizes are the ones referenced as a, b, c, e, g, h, j and m. The resilient foam core 16 may be molded as one piece or may be cut from a piece of foam stock, using an electric knife. Another possible construction technique is to provide layers of pre-cut foam stacked on top of each other, and adhesively secured.

While particular embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. An infant positioner for supporting and positioning an infant in a tucked prone position, said infant positioner having a length and a width, made of a resilient foam material having a density for supporting the infant, and comprising:

an elongated base layer extending lengthwise from a head end to a feet end, said elongated base layer including, in order, a head support portion having a width at least sufficient to fully support the head of the infant, a torso support portion having a width sized to correspond to the width of the torso of the infant, and a pelvis support portion, said pelvis support portion ranging in width from the width of said torso support portion to a narrower width corresponding to the distance between the legs of the infant;

a pair of arm recesses in said torso support portion extending through the entire thickness of said torso support portion configured and located in a position generally corresponding to the shoulders of the infant such that the arms of the infant are allowed to be rounded and tucked into a position of flexion;

said pelvis support portion terminating in an upwardly extending rear support for the buttocks of the infant, said upwardly extending rear support having a width corresponding to the distance between the legs of the infant and configured so as to allow the infant to maintain the tucked prone position without sliding towards said feet end of said infant positioner;

a pair of upwardly and rearwardly extending lateral supports connected to said torso support portion, said lateral supports spaced a distance apart corresponding to the width of the torso of the infant, and extending lengthwise from said arm recesses to the feet end of said infant positioner; and a pair of leg recesses, each of said leg recesses being defined between one of said upwardly extending lateral supports, and said pelvis support portion and said upwardly extending rear support which terminates said pelvis support portion.

2. The infant positioner of claim 1, wherein said base layer decreases in thickness from said torso support portion to a cavity formed in said head support portion to at least assist in maintaining the head of the infant centered widthwise in said head support portion.

3. The infant positioner of claim 1, which further comprises a longitudinal trough formed in said torso and pelvis support portions in order to maximize support area for the torso of the infant.

4. The infant positioner of claim 1, which further comprises a cavity formed in said head support portion to at least assist in maintaining the head of the infant centered widthwise.

5. The infant positioner of claim 1, which further comprises a foot brace extending across the feet end of said infant positioner at least between said lateral supports, said foot brace being configured and positioned such that the feet of the infant are braced against said foot brace during use.

6. The infant positioner of claim 5, wherein said foot brace comprises webbing.

7. The infant positioner of claim 6, wherein said foot brace comprises elastic webbing.

8. The infant positioner of claim 1, which further comprises containment straps that can wrap around said infant positioner and extend across the upper back and hips of the infant.

9. The infant positioner of claim 1, which further comprises a form fitting washable cover over the resilient foam material.

10. The infant positioner of claim 9, which further comprises a foot brace attached to said cover and extending across the feet end of said infant positioner at least between said lateral supports, said foot brace being configured and positioned such that the feet of the infant are braced against said foot brace during use.

11. The infant positioner of claim 10, wherein said foot brace comprises webbing.

12. The infant positioner of claim 11, wherein said foot brace comprises elastic webbing.

13. The infant positioner of claim 9, which further comprises containment straps attached to said cover that can wrap around said infant positioner and extend across the upper back and hips of the infant.

14. The infant positioner of claim 1, which is provided in a plurality of standardized sizes.

* * * * *